United States Patent [19]

Oda et al.

[11] 4,199,619

[45] Apr. 22, 1980

[54] PROCESS FOR PREPARING AN ACCEPTOR COATED SHEET FOR USE IN A PRESSURE SENSITIVE COPYING SYSTEM

[75] Inventors: Shinichi Oda, Nishinomiya; Hiroshi Tsuchiya, Hirakata; Takao Matsushita, Kobe; Takio Kuroda, Amagasaki, all of Japan

[73] Assignee: Kanzaki Paper Manufacturing Co., Ltd., Tokyo, Japan

[21] Appl. No.: 908,765

[22] Filed: May 23, 1978

[30] Foreign Application Priority Data

May 27, 1977 [JP] Japan ..... 52-62529

[51] Int. Cl.[2] ..... B41M 5/16; B41M 5/22

[52] U.S. Cl. ..... 427/150; 106/21; 282/27.5; 427/151; 427/152; 428/307; 428/500; 428/521; 428/914

[58] Field of Search ..... 106/21, 27–30; 282/27.5; 427/150, 151, 152; 428/307, 411, 913, 914, 500, 537, 521

[56] References Cited

U.S. PATENT DOCUMENTS

| | | | |
|---|---|---|---|
| 3,924,027 | 12/1975 | Saito et al. | 427/147 |
| 4,051,303 | 9/1977 | Hayashi et al. | 428/411 |
| 4,055,358 | 10/1977 | Garner et al. | 282/27.5 |
| 4,076,887 | 2/1978 | Tsuji et al. | 428/307 |

*Primary Examiner*—Bruce H. Hess

*Attorney, Agent, or Firm*—Morgan, Finnegan, Pine, Foley & Lee

[57] ABSTRACT

A process for preparing an acceptor coated sheet used in a pressure sensitive copying system is disclosed. The pressure sensitive copying system utilizes a color forming reaction on a base sheet between the color former in the form of the oily core material encapsulated in microcapsules and the organic acceptor included in an acceptor coating layer formed on said base sheet. The acceptor coating layer includes as a binder a carboxylic latex having an oil swellability smaller than 65% in terms of the swelling with the oily core material. An ester of an organic acid is further included within the microcapsules and/or in the acceptor coating layer.

7 Claims, No Drawings

PROCESS FOR PREPARING AN ACCEPTOR COATED SHEET FOR USE IN A PRESSURE SENSITIVE COPYING SYSTEM

BACKGROUND OF THE INVENTION

This invention relates to a pressure sensitive copying system and more particularly to pressure sensitive copying paper having a good light resistance, a good color formability and an improved printability.

Usually the so-called "pressure sensitive copying system" consists of these three kinds of basic sheets such as top sheet, middle sheet and bottom sheet, wherein the top sheet is coated on the underside thereof with a composition consisting mainly of pressure-rupturable microcapsules each enclosing an oil droplet containing an electron donating organic chromogenic material (hereinafter referred to as "color former") dissolved or dispersed therein, the middle sheet is coated on the upperside thereof with another composition consisting mainly of electron accepting acidic reactant material (hereinafter referred to as "acceptor") which will produce a colored image when contact with the color former and also is coated on the underside thereof with the composition of microcapsules containing oil droplets in which a color former is dissolved or dispersed and the bottom sheet is coated on the upperside thereof with the composition of acceptor. One top sheet and one bottom sheet or, one top sheet, at least one middle sheet and one bottom sheet are superposed in that order to form a set of copying sheet in such a manner that the microcapsule coating layer and the acceptor coating layer are in contact with each other in each adjoining two sheets. Any partial pressing on the upperside of the top sheet of the thus prepared copying system with a pen or a typewriter will break the microcapsules positioned on the pressing, resulting in making the color former react with the acceptor so as to develop a color only on the part pressed.

In another pressure sensitive copying system, there are disposed on one surface of the same sheet both the acceptor and the microcapsules containing oil droplets in which the color former is dissolved or dispersed. This system is known as the "self contained" system.

Recently, various organic acid materials have found their usefulness as the acceptor for the pressure sensitive copying system. Among those organic acceptors there ae included phenols, phenolic polymers, carboxylic acids and other acidic polymers.

In comparison with inorganic acceptors such as acid clay and activated clay, the above mentioned organic acceptors are advantageous and have a good reputation for the reason that they have a good color formability which can be retained for a long time and the color images produced are stable and have a good light resistance and a good moisture resistance. However, the color images produced on such organic acceptors never become stable until several to twenty hours or more after the color images has been developed and the light resistance of the color images immediately after the color developing is rather unsatisfactory.

The principal object of the invention is to provide an improved pressure sensitive copying system in which the light resistance of the developed color images, especially the light resistance immediately after the color developing, is remarkably enhanced.

Another object of the invention is to provide an improved pressure sensitive copying sheet or paper having a good color formability.

A further object of the invention is to provide an improved pressure sensitive copying sheet or paper having a good printability.

Other objects and advantages of the invention will be apparent from the following description.

SUMMARY OF THE INVENTION

According to the invention the stability of the color images against light immediately after the color developing is enhanced by utilizing as a binder in the acceptor coating layer a carboxylic latex having an oil swellability smaller than 65% in terms of the swelling with the oily core material enclosed in the color former microcapsules.

Any degradation of the instant color developing property which may be involved with use of the above mentioned carboxylic latex having a relatively small oil swellability can be prevented by utilizing an ester of an organic acid within the color former microcapsules and/or in the acceptor coating layer.

DETAILED DESCRIPTION OF THE INVENTION

The invention is applied to the pressure sensitive copying system in which a color forming reaction can occur, on a base sheet, between the color former in the form of the oily core material encapsulated in microcapsules and the organic acceptor included in an acceptor coating layer.

The color former microcapsules and the organic acceptor may be disposed on the surfaces of different sheets or on one surface of the same sheet. In the latter case, both the color former microcapsules and the organic acceptor may also be included either in the respective different coating layers or on a single coating layer on a base sheet.

Among the useful organic acceptors there may be included various aromatic carboxylic acids such as benzoic acid, p-tert-butyl-benzoic acid, 4-methyl-3-nitrobenzoic acid, salicylic acid, 3-phenyl salicylic acid, 3-cyclohexyl salicylic acid, 3-tert-butyl-5-methyl salicyclic acid, 3,5-di-tert-butyl salicylic acid, 3-methyl-5-benzyl salicylic acid, 3-phenyl-5-(α,α-dimethylbenzyl)salicylic acid, 3-cyclohexyl-5-α,α-dimethylbenzyl)salicylic acid, 3-(α,α-dimethylbenzyl)-5-methyl salicylic acid, 3,5-di-cyclohexyl salicylic acid, 3,5-di-(α-methylbenzyl)salicylic acid, 3,5-di-(α,α-dimethylbenzyl)salicylic acid, 3-(α-methylbenzyl)-5-(α,α-dimethylbenzyl)salicylic acid, 4-methyl-5-cyclohexyl salicylic acid, 2-hydroxy-1-benzyl-3-naphthoic acid, 1-benzoyl-2-hydroxy-3-naphthoic acid, 3-hydroxy-5-cyclohexyl-2-naphthoic acid and the like, and polyvalent metallic salts thereof such as zinc salts, aluminum salts, magnesium salts, calcium salts and cobalt salts as disclosed in U.S. Pat. Nos. 3,864,146, 3,924,027 and 3,983,292; phenol compounds such as 6,6'-methylenebis-(4-chloro-m-cresol) as disclosed in Japanese Patent Publications Nos. 9,309 of 1965 and 20,144 of 1967, and Japanese Laid Open Patent Publication No. 14,409 of 1973; phenol resins such as phenol-aldehyd resins e.g. p-phenylphenol-formaldehyd resin and phenol-acetylene resins e.g. p-tert-buthylphenol-acetylene resin, and polyvalent metallic salts thereof; acid polymers such as maleic acid-rosin resin and copolymers of maleic anhydride with styrene, ethylene or vinylmethylether; and aromatic carboxylic acid-aldehyde polymers, aromatic carboxylic acid-acetylene polymers and their polyvalent metallic salts as disclosed in U.S. Pat. Nos. 3,767,449 and 3,772,052.

The most preferable organic acceptors are aromatic carboxylic acids, phenol resins, copolymers of aromatic carboxylic acids with aldehyd or acetylene and polyvalent metallic salts the foregoing.

The term "oil core material" described means the oil material which is enclosed in each color former microcapsule and comprises a non-volatile oil, a color former dissolved or dispersed in said non-volatile oil and other various additives which may be added when required. The color former microcapsules may be produced by any conventional method e.g., by the "coacervation" technique, by the "interfacial polymerization" technique or by the "in-situ polymerization" technique.

At least one of various known color former compounds for pressure sensitive copying paper may be used for the invention. Among them there may be included triarylmethane compounds such as 3,3-bis(p-dimethylamino-phenyl)-6-dimethylaminophthalide (CVL), diphenylmethane compounds such as N-2,4,5-trichlorophenyl-leuco-auramine, xanthene compounds such as rhodamine-B-anilinolactam, thiazine compounds such as benzoylleucomethyleneblue and spiro compounds such as 3-methyl-spiro-dinaphthopyrane. The most preferred color former compounds are those having lactone ring or lactam ring.

The non-volatile oil for dissolving or dispersing the color former therein may be any of animal oils, vegetable oils, mineral oils and synthetic oils so far as they are substantially odorless, stable in microcapsules and non-poisonous. Among the useful non-volatile oils there may be included alkylnaphthalene, alkylbenzene, hydrogenated terphenyl, diphenyl alkane, triaryldimethane, alkylbiphenyl, kerosene, chlorinated paraffine, cotton seed oil, linseed oil, soybean oil and colza oil. Generally at least one of alkylnaphthalene, alkylbenzene, hydrogenated terphenyl, diphenylalkane, alkylbiphenyl, and kerosene are preferably used.

After considerable studies and experiments aiming at improvement of the light resistance of the color images immediately after the color developing in the above mentioned organic acceptor-color former-non-volatile oil system, we have found that the light resistance of the color images is highly affected by the non-volatile oil used, especially, the light resistance is degraded by existence of non-volatile oil in the color images produced as a result of a reaction between the color former and the acceptor. It has also been found that the latex used as a binder for the acceptor is another important factor for the light resistance of the color images. That is, if a latex having a relatively large oil swellability is used as a binder for the acceptor, it retains non-volatile oil in the acceptor coating layer for a long time after the color images are produced with the result of degrading the light resistance of the color images.

According to the invention, thus, a carboxylic latex having such a relatively small oil swellability as smaller than 65%, more preferably, smaller than 40%, in terms of the swelling with the oily core material of the color former microcapsules is used as a binder in the organic acceptor coating layer. The oil swellability is given by the following formula:

$$\text{Oil swellability (\%)} = \frac{W - W_o}{W_o} \times 100$$

wherein $W_o$ is the weight of a sample latex film before swelling and W is the weight of a sample latex after swelling with the oily core material. The sample latex film is prepared by forming a film having a thickness of 1 mm at 40° C., drying it for 30 minutes at 120° C. and cooling it to 20° C. The value of W is measured after dipping the sample latex film in the oily core material at the room temperature for five hours and wiping the oily core material from the swelled latex film surfaces.

The latex is selected according to the kind of the oily core material used. The latex may be used either solely or in combination insofar as it has an oil swellability as specified in the above. In the production of the latex the kind and amount of starting monomers, modifier, chain transfer agent, polymerization initiator, bridging agent and cross-linking agent and the conditions such as the polymerization time and temperature should be selected so as to be able to obtained a latex having a desired property.

One of the preferred compositions of monomers for the production of the latex useful for the invention is as follows:

(1) 30–50% by weight of diolefines (e.g. dienes having 4 to 10 carbon atoms such as 1,3-butadiene, methylbutadiene and pentadiene)

(2) 30–70% by weight of monoolefines (e.g. styrene, α-methyl styrene, vinyltoluene, methylacrylate, ethylacrylate, methylmethacrylate and acrylonitrile)

(3) 0.5–15% by weight of unsaturated carboxylic acids (e.g. mono- and di-carboxylic acids such as acrylic acid, methacrylic acid, maleic acid, itaconic acid and fumaric acid).

In some cases the use of a latex having a relatively small oil swellability results in reducing the instant color formability though the before-mentioned good light resistance is always secured. According to the invention this decline in the instant color formability can be prevented by using an ester material within the color former microcapsules and/or in the acceptor coating layer.

Among the ester materials useful for the above purpose, there may be included aliphatic monocarboxylic acid ester such as butyl acetate, butyl oleate and methyl valerate; aliphatic dicarboxylic acid ester such as dimethyl oxalate, diethyl oxalate, dimethyl malonate, diethyl malonate, dimethyl succinate, diethyl succinate, dioctyl succinate, monomethyl succinate, dimethyl adipate, diethyl adipate, diisodecyl adipate, dioctyl adipate, monomethyl adipate, monoethyl adipate, dibutyl sebacate, dioctyl sebacate, dimethyl maleate, diethyl maleate, butylethyl maleate, dimethyl itaconate, dimethyl glutarate and diethyl glutarate; aromatic monocarboxylic acid ester such as methyl benzoate, ethyl benzoate, propyl benzoate, methyl anthranilate, methyl salicylate, ethyl salicylate, isopropyl salicylate, isoamyl salicylate, octyl salicylate and methyl oxy-m-toluylate; aromatic dicarboxylic acic ester such as dimethyl phthalate, diethyl phthalate, dibutyl phthalate, dicotyl phthalate, dinonyl phthalate, diisodecyl phthalate, dicyclohexyl phthalate, methylethyl phthalate, butylbenzyl phthalate and ethylphthalyl ethylene glycol; phosphate such as tributyl phosphate and tricresyl phosphate; tributyl acetylcitrate; triacetin; trioctyl trimellitate and ester compounds such as polypropylene adipate.

The most preferred esters are esters of aliphatic or aromatic dicarboxylic acids, especially, esters of organic acids having 4 to 8 carbon atoms with alcohols having 1 to 8 carbon atoms. The above esters of organic acids may be used solely or in combination.

In case where the above mentioned ester material is included in the non-volatile oil enclosed in the color former microcapsules the amount of the ester material may be within the range of 0.5 to 30% by weight, preferably 1 to 15% by weight, of the oily core material.

If the ester is included in the acceptor coating layer, the amount of the ester added may be within the range of 0.01 to 50 parts by weight, preferably 0.05 to 10 parts by weight per 100 parts by weight of the acceptor in the coating layer.

In a preferred embodiment of the invention the ester material is mixed with the acceptor when the acceptor composition is prepared so that the ester material and the acceptor are homogeneously included in the coating layer formed. For example, in the preparation of an organic acceptor composition by combining an organic acceptor with a co-soluble organic high molecular compound such as polystylene, poly-α-methylstylene, polyethylene or copolymers thereof to form a mixed melt, the above mentioned ester may also be added thereto to form a homogeneous composition.

Addition of the ester material to the acceptor coating layer is more advantageous than addition of the ester material to the color former microcapsules since the former step results in enhancing the printability on the acceptor coating layer. In some cases, a latex having a relatively small oil swellability is inferior in the adhesive strength. The decline in the adhesive strength is recognized when the oil swellability of the latex is smaller than 50%. The use of the latex in an excess amount to obtain a required adhesive strength is not desirable since it results in lowering the color formability of the acceptor coated paper. However, if the above mentioned ester material is included in the acceptor coating layer, even with use of a latex having a relatively small oil swellability, the adhesive strength can be increased without sacrifying the color formability. This will find its particular usefulness for the dry offset printing in which a stronger printing pressure is required.

The acceptor coating composition may also include clay mineral such as activated clay, acid clay, calcined activated clay, clay, kaolin, calcined kaolin, bentonite, attapulgite and the like; water-insoluble inorganic pigment such as zinc oxide, aluminum hydroxide, calcium carbonate, calcium sulfite, synthetic aluminum silicate and the like; water-soluble polymers such as starchs, carboxy-methylcellulose, hydroxyethylcellulose, sodium alginate, polyvinylalcohol, sodium polyacrylate and the like; and other various agents for coating such as dispersing agents, antiforming agents, stabilizers, water retaining agents, lubricants, waxes, antiseptics and the like.

Any conventional devises may be used for preparing the coating composition. Among those conventional devises for preparing the coating composition there may be included propeller mixers, sand grinders, KD mills, kneaders and attritors.

Any conventional coating technique may also be used for the formation of the acceptor coating layer and the microcapsule coating layer on a surface of a base sheet. The amount of the coating composition applied is not limited to any specified range but may be within the conventionally acceptable range.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

Preparation of Latexes

Such monomers as shown in Table 1 were copolymerized at 70° C. for 17 hours in an aqueous system comprising 1.0 part of potassium persulfate, 1,0 part of sodium alkylbenzenesulfonate, 0.8 parts of sodium hydrogencarbonate and 130 parts of water to prepare eleven carboxylic latexes.

Table 1

| | Latexes | | | | | | | | | | |
|---|---|---|---|---|---|---|---|---|---|---|---|
| Monomer | A | B | C | D | E | F | G | H | I | J | K |
| Butadiene 1-3 | 33 | 45 | 38 | 35 | 35 | 48 | 30 | 35 | 27 | 43 | 48 |
| Styrene | 61 | 50 | 56 | 55 | 60 | 23 | 64 | 57 | 70 | 53 | 23 |
| Methylmethacrylate | — | — | — | — | — | 25 | — | 8 | — | — | 25 |
| Fumaric acid | 6 | — | 3 | 5 | — | — | 6 | — | 3 | 3 | 4 |
| Acrylic acid | — | 5 | — | 4 | 5 | 4 | — | — | — | 1 | — |
| 2-Hydroxyethylacrylate | — | — | 3 | 1 | — | — | — | — | — | — | — |
| Divinylbenzene | — | 1 | — | — | 1 | — | — | — | — | — | — |
| Ethylene Glycol Dimethacrylate | — | — | — | 1 | — | — | — | — | — | — | — |
| Dodecyl Mercaptan | 0.01 | — | 0.04 | — | 0.2 | 0.02 | 0.5 | 0.3 | 0.4 | 0.6 | 0.6 |

Preparation of Microcapsule Coated Paper

An oily material obtained by dissolving 3 parts of crystal violet lactone and 1 part of benzoyl leuco methylene blue in each of the oil composition systems shown in Table 2 was encapsulated by the complex coacervation method with use of 20 parts of gelatin and 20 parts of gum arabic as a capsulewall forming material. The average particle size of the obtained microcapsules was 6.5 microns. To each of the obtained microcapsule dispersions, 20 parts of pulp powder, 10 parts of finely divided raw starch powder and 20 parts of gelatinizated starch were added to obtain four different microcapsule coating compositions. The four different coating compositions were applied four sheets of paper of 42 g/m$^2$ at their respective one surfaces in an amount of 5 g/m$^2$ on dry basis and dried to obtain four microcapsule coated papers.

Table 2

| | Capsule Coated Paper | | | |
|---|---|---|---|---|
| Oil System | I | II | III | IV |
| Diisopropyl- | | | | |

Table 2-continued

| | Oil System | Capsule Coated Paper I | II | III | IV |
|---|---|---|---|---|---|
| Nonvolatile Oil | naphthalene | 95 | — | 75 | 100 |
| | Xylylphenylethane | — | 80 | — | — |
| | Kerosene | — | 13 | 20 | — |
| | Diethyl Maleate | 5 | — | — | — |
| Ester Compounds | Dimethyl Agipate | — | 7 | — | — |
| | Diethyl Agipate | — | — | 5 | — |

(Note)
Diisopropylnaphthalene: KMC oil manufactured by Kureha Kagaku Kogyo Kabushiki Kaisha.
Xylylphenylethane: NISSEKI HISOL SAS manufactured by Nippon Petrochemicals Co., Ltd.

Preparation of Acceptor Coated Papers

15 Parts of organic acceptor as indicated in Table 3 was added to 300 parts of water with 20 parts of calcium carbonate, 30 parts of aluminum hydroxide, 20 parts of activated clay, 15 parts of zinc oxide, 0.8 parts of sodium polyacrylate and an ester compound in such an amount as indicated in Table 3. Each of the obtained mixtures was passed through a sand grinder. Then to each the mixtures, further, 40 parts of 10% aqueous solution of oxidized starch and 15 parts of carboxylic latex on dry basis as shown in Table 3 were added and admixed to prepare sixteen acceptor coating compositions. The coating compositions were coated 16 sheets of paper of 42 g/m$^2$ on their respective one surfaces in an amount of 6 g/m$^2$ on dry basis and dried to obtain sixteen acceptor coated papers.

Table 3

| Acceptor Coated Papers | Organic Acceptors a | b | c | d | Ethyl Compounds Diethyl Succinate | Dimethyl Agipate | Diethyl Malonate | Triacetin | Latexes |
|---|---|---|---|---|---|---|---|---|---|
| 1 | 15 | — | — | — | — | — | — | — | A |
| 2 | 15 | — | — | — | — | — | — | — | B |
| 3 | 15 | — | — | — | — | — | — | — | G |
| 4 | 15 | — | — | — | — | — | — | — | H |
| 5 | 15 | — | — | — | 1 | — | — | — | A |
| 6 | 15 | — | — | — | — | 1 | — | — | B |
| 7 | — | 15 | — | — | — | — | — | — | C |
| 8 | — | 15 | — | — | — | — | — | — | D |
| 9 | — | 15 | — | — | — | — | — | — | I |
| 10 | — | 15 | — | — | — | — | — | — | J |
| 11 | — | 15 | — | — | — | — | 0.5 | — | C |
| 12 | — | — | 15 | — | — | — | — | — | E |
| 13 | — | — | 15 | — | — | — | — | — | F |
| 14 | — | — | 15 | — | — | — | — | — | K |
| 15 | — | — | 15 | — | — | — | — | 1 | E |
| 16 | — | — | — | 15 | — | — | — | — | F |

(Note)
Organic Acceptor a: zinc 3,5-di(α-methylbenzyl)salicylate
Organic Acceptor b: powders obtained by fusing at 150° C. a mixture of 30 parts of styrene oligomer with 70 parts of zinc 3-phenyl-5-(α,α-dimethylbenzyl) salicylate and then pulverizing the fused mixture.
Organic Acceptor c: p-octylphenol-formaldehyde resin
Organic Acceptor d: powders obtained by fusing at 150° C. a mixture of 30 parts of styrene oligomer with 70 parts of zinc 3,5-di(α-methylbenzyl)salicylate and 0.1 parts of dimethylphthalate and then pulverizing the fused mixture.

Each of the microcapsule coated papers were combined with the acceptor coated papers to prepare 21 pressure sensitive copying paper systems as shown in Table 4. The properties of the pressure sensitive copying paper systems were examined in the following methods. The results are shown in Table 4.

(1) Test for Color Formability

The copying paper system was typewritten, and then the color density of developed images on the acceptor coated surface was measured with a spectrometer (Hitachi Double Beam Spectrometer 124 manufactured by Hitachi, Ltd. Japan). The color formability was represented with the peak value at 610 mμ of visible absorption spectra after 24 hours from the color forming. The larger the value, the more superior the color formability.

(2) Test for Instant Color Formability

A metal plate, which had a weight of 330 g and a contact area of 0.7 cm$^2$, was thrown down from a height of 35 cm on the copying paper system to form a color image by the striking pressure. After 10 seconds and after 3 hours from the color forming, the color density of the image on the acceptor coated surface was measured with the use of red filter by Macbeth densitometer RD-100R (manufactured by Macbeth Corporation, USA) respectively. The instant color formability was represented with the ratio of the color density after 30 seconds to that after 3 hours. The larger the ratio, the more superior the instant color formability.

(3) Test for the Light Resistance of Color Images

Immediately after typewriting the copying paper system, the developed color image was irradiated with a xenon lamp for 2 hours. Then the color density of the image was measured by a spectrometer (Hitachi Double Beam Spectrometer 124 manufactured by Hitachi, Ltd. Japan). The light resistance of color images was represented with the peak value at 610 mμ of visible absorption spectra.

(4) Test for Printability

The adhesive strength of the coating surface of the acceptor coated paper was examined with the use of an ink having a tackiness of 15 by RI printing tester (manufactured by AKIRA Seisakusho, Japan). The printability was represented with five stages evaluation of eyes. The larger the value, the more superior the printability.

The degree of swelling of the latexes was measured with the oily material contained in the capsules of the combined capsule coated paper, respectively.

Table 4

| | Combination of Papers as a Pressure Sensitive Copying Paper System | | | | | | Properties of Copying Paper | | | |
|---|---|---|---|---|---|---|---|---|---|---|
| | Capsule Coated Paper | | Acceptor Coated Paper | | | | | | | |
| | | | | | Latex | | Color | Instant | Light Resistance of Color | |
| | No. | Ester Compound | No. | Ester Compound | No. | Degree of Swelling (%) | Formability (× 1/100) | Color Formability | Images (× 1/100) | Print-ability |
| Example 1 | I | O | 1 | x | A | 15 | 50 | 0.82 | 22 | 3 |
| Example 2 | II | O | 2 | x | B | 40 | 50.5 | 0.83 | 21.5 | 3 |
| Example 3 | III | O | 7 | x | C | 45 | 49.5 | 0.82 | 22 | 3 |
| Example 4 | IV | x | 1 | x | A | 12 | 50 | 0.70 | 23 | 3 |
| Example 5 | IV | x | 2 | x | B | 8 | 50.5 | 0.70 | 22.5 | 3 |
| Example 6 | IV | x | 7 | x | C | 35 | 49.5 | 0.71 | 23 | 3 |
| Example 7 | IV | x | 8 | x | D | 35 | 49.5 | 0.69 | 21 | 3 |
| Example 8 | IV | x | 12 | x | E | 9 | 48 | 0.68 | 18 | 3 |
| Example 9 | IV | x | 13 | x | F | 25 | 47 | 0.68 | 17 | 3 |
| Example 10 | IV | x | 5 | O | A | 12 | 49 | 0.73 | 22 | 5 |
| Example 11 | IV | x | 6 | O | B | 8 | 50 | 0.73 | 21.5 | 5 |
| Example 12 | IV | x | 11 | O | C | 35 | 49.5 | 0.73 | 22 | 5 |
| Example 13 | IV | x | 15 | O | E | 9 | 48 | 0.71 | 18 | 5 |
| Example 14 | IV | x | 16 | O | F | 25 | 49 | 0.74 | 21.5 | 5 |
| Example 15 | I | O | 6 | O | B | 18 | 50 | 0.83 | 21 | 5 |
| Example 16 | II | 11 | O | C | 60 | 50.5 | 0.84 | 20 | 5 | |
| Control 1 | IV | x | 3 | x | G | 80 | 50 | 0.75 | 10 | 4 |
| Control 2 | IV | x | 4 | x | H | 70 | 50 | 0.74 | 9 | 4 |
| Control 3 | IV | x | 9 | x | I | 75 | 50 | 0.72 | 14 | 4 |
| Control 4 | IV | x | 10 | x | J | 80 | 51 | 0.73 | 10 | 4 |
| Control 5 | IV | x | 14 | x | K | 90 | 49.5 | 0.74 | 8 | 4 |

(Note)
O: Ester compound is comprised.
x: Ester compound is not comprised.

As shown in Table 4, the pressure sensitive copying paper system in each of the examples according to the invention was superior in the light resistance of the color images immediately after the color developing, but the pressure sensitive copying paper system with use of a latex having an oil swellability larger than 65% as a binder of acceptor coated paper (in each of Controls 1 to 5) was very bad in the light resistance immediately after the color developing.

What is claimed is:

1. A process for preparing an acceptor coated sheet used in a pressure sensitive copying system utilizing a color forming reaction on a base sheet between the color former in the form of the oily core material encapsulated in microcapsules and the organic acceptor in an acceptor coating layer formed on said base sheet, the improvement which comprises said base sheet being coated with a composition comprising at least one organic acceptor and a carboxylic latex having an oil swellability smaller than 65% in terms of the swelling with said oily core material.

2. A process according to claim 1 in which said organic acceptor is a member selected from the group consisting of aromatic carboxylic acids, polyvalent metal salts thereof, phenol resins, polyvalent metal salts thereof, polymers of aromatic carboxylic acids with aldehyde or acetylene, polyvalent metal salts of those polymers and mixtures thereof.

3. A process according to claim 1 in which an ester material is included within said microcapsules and/or in said acceptor coating layer.

4. A process according to claim 3 in which said ester material is an ester of an organic acid selected from the group consisting of esters of aliphatic monocarboxylic acids, aliphatic dicarboxylic acids, aromatic monocarboxylic acids and aromatic dicarboxylic acids.

5. A process according to claim 4 in which said ester is an ester of an organic acid having four to eight carbons.

6. A process according to claim 3 in which said ester material is included within said microcapsules in an amount within the range of 0.5 to 30% by weight of said oily core material.

7. A process according to claim 3 in which said ester material is included in said acceptor coating layer in an amount within the range of 0.01 to 50 parts by weight per 100 parts by weight of said organic acceptor.

* * * * *